US005255658A

United States Patent [19]

Hoffer et al.

[11] Patent Number: 5,255,658

[45] Date of Patent: Oct. 26, 1993

[54] SYSTEM AND APPARATUS TO IMPROVE ATOMIZATION OF INJECTED FUEL

[75] Inventors: Peter Hoffer, Roseville; Thomas J. Hemak, Troy, both of Mich.

[73] Assignee: Coltec Industries Inc., New York, N.Y.

[21] Appl. No.: 596,441

[22] Filed: Oct. 12, 1990

[51] Int. Cl.[5] ..... F02M 23/00

[52] U.S. Cl. ..... 123/531; 123/585

[58] Field of Search ..... 123/531, 533, 585, 590, 123/456

[56] References Cited

U.S. PATENT DOCUMENTS

| | | | |
|---|---|---|---|
| 1,238,828 | 9/1917 | Schenker | 123/531 |
| 1,418,232 | 5/1922 | Charles | 123/531 |
| 4,216,174 | 8/1980 | Szott | 123/531 |
| 4,556,037 | 12/1985 | Wisdom | 123/531 |
| 4,570,602 | 2/1986 | Atkins | 123/456 |
| 4,754,740 | 7/1988 | Eminenthal | 123/585 |
| 4,794,902 | 1/1989 | McKay | 123/531 |
| 4,938,417 | 7/1990 | Halvorsen | 123/531 |
| 4,982,716 | 1/1991 | Takeda | 123/531 |
| 4,986,248 | 1/1991 | Kobayashi | 123/590 |
| 5,027,778 | 7/1991 | Nogi | 123/531 |

FOREIGN PATENT DOCUMENTS

| | | | |
|---|---|---|---|
| 659535 | 4/1938 | Fed. Rep. of Germany | 123/531 |
| 535753 | 4/1922 | France | 123/531 |
| 0220960 | 12/1983 | Japan | 123/531 |

*Primary Examiner*—Carl S. Miller
*Attorney, Agent, or Firm*—Howard S. Reiter

[57] ABSTRACT

A fuel metering and injection system is shown having air nozzles communicating with a source of air and effective for directing a flow of air as to impinge upon the flow of fuel as has been metered and injected into the induction system of an associated engine.

12 Claims, 9 Drawing Sheets

SYSTEM AND APPARATUS TO IMPROVE ATOMIZATION OF INJECTED FUEL

FIELD OF INVENTION

This invention relates generally to fuel injection systems for combustion engines, and more particularly to means for improving the atomization of the fuel being injected.

BACKGROUND OF THE INVENTION

The automotive industry has over the years continually exerted efforts to improve both the fuel economy and the operating performance of automotive engines.

The trend has been, and continues to be, to employ various forms of fuel injection apparatus in order to be able to meter the rate of fuel flow to the associated engine with an accuracy greater than that attainable as by, for example, carburetor structures.

Prior art fuel injection systems may be grouped, broadly, into two categories. That is, a first of such categories would comprise those systems wherein the fuel injector (or injectors) inject metered fuel into the induction passage means of a throttle body structure from where the resulting fuel-air mixture flows to be divided among a plurality of branches or runners of a downstream-situated induction or intake manifold and ultimately delivered to and discharged in close proximity to the respective intake valve means of the plurality of engine cylinders. This first category at times experiences difficulties in that because of design, packaging and/or manufacturing tolerances employed in the production of intake manifolds, for example, the flow characteristics of all of the branches or runners of the intake manifold are not identical. This, in turn, results in certain of the engine cylinders experiencing fuel "starvation" and, generally, the manner of correcting such fuel "starvation" is to increase the total rate of metered fuel to the engine so that no engine cylinder experiences any fuel "starvation". However, by employing such a corrective approach other engine cylinders, of necessity, are provided with an overly rich (in terms of fuel) fuel-air mixture which, of course, means that the potential maximum fuel economy of the engine is not being attained.

The second category would comprise those systems wherein respective ones of a plurality of fuel injector assemblies are situated so as to discharge metered fuel in close proximity to respective intake valve means of the corresponding engine cylinders thereby providing greater assurance that each engine cylinder will be supplied with the required rate of metered fuel flow especially since such metered fuel does not have to flow through the effective length of the intake manifold runners and thereby possibly be deleteriously affected thereby.

However, both of such categories continue to experience the problem of obtaining a desired or optimum degree of metered fuel atomization. Generally, the greater the atomization of fuel, the better the combustion process will be within the engine cylinder which, in turn, will provide always desired better engine performance, reduced engine exhaust emissions and increased engine fuel economy.

Accordingly, the invention as herein disclosed and described is directed primarily to improving the atomization of injected fuel as well as to the solution of other related and

SUMMARY OF THE INVENTION

In one aspect to the invention, apparatus for supplying rates of metered fuel flow to an associated engine, comprises one or more (usually fewer than the number of engine cylinders) fuel injector means for metering the rate of fuel flow to induction passage means of said engine, and air nozzle means, said air nozzle means being effective to direct a stream of air to impinge upon said fuel flow as has been metered by said one or more fuel injector means to thereby atomize said metered fuel flow, and wherein said air and said atomized metered fuel flow thereafter both flow to a combustion chamber of said engine.

In another aspect of the invention, apparatus for supplying rates of metered fuel flow to an associated engine having a plurality of cylinders or combustion chambers, comprises a plurality of fuel injector means wherein the number of said fuel injector means is equal to the number of said combustion chambers, and a plurality of air nozzle means wherein the number of said air nozzle means is equal to the number of said plurality of fuel injector means, wherein each of said plurality of fuel injector means is effective for metering the rate of fuel flow to a respective one of said plurality of combustion chambers, wherein each of said plurality of air nozzle means is associated with a respective one of said plurality of fuel injector means and is effective to direct a stream of air to impinge upon said fuel flow as has been metered by said associated respective one of said injector means to thereby atomize said metered fuel flow, and wherein said air and said atomized fuel flow both flow to a respective one of said combustion chambers associated with said respective one of said fuel injector means.

Still another aspect of the invention comprises mounting such plurality of fuel injectors on a supporting structure, such as a fuel rail, which rail may also include, or have associated therewith, an air control device, such as a stepper motor that controls both by-pass idle air (in an engine having a throttle valve that completely closes the induction passage at idle so that air for engine idle is supplied through a controlled passage by-passing the closed throttle plate) and shrowding air (the air that impinges on the metered fuel from the injector for improved atomization).

More specifically, the invention comprises means adapted to improve atomization of fuel emanating from the discharge of an electronically controlled fuel injection system. Basically, the invention contemplates use of the energy of by-pass air, controlled either by an idle air control circuit or a separate air pump, to accomplish a fuel atomization function.

In one embodiment of the invention, air routed from the air cleaner is controlled by an air control assembly including a mechanically adjustable orifice and an electrically adjustable orifice (e.g. stepper motor). The airflow path leaving this assembly is routed to a fuel rail that contains a longitudinal passage which intersects an air annulus at each injector site, the annulus feeding air to an air distribution manifold which contains suitably sized apertures. The apertures are arranged so as to impinge the fuel spray, the impact of which causes the fuel droplets to be broken (atomized) into smaller droplets. This would have the effect of improving the further atomization of the fuel to improve the quality of the subsequent combustion. A further important advantage of this embodiment of the invention is that the cylinder-to-cylinder distribution of the by-pass air is much improved over systems that simply route all by-pass/air back into the intake manifold plenum upstream of the individual runners.

The above embodiment uses the natural aspiration (manifold vacuum) of the engine to cause the air to flow. At low intake manifold pressures (as would be present at idle) the pressure drop between the air cleaner and the intake manifold would cause the air to flow. Normal idle air control can be obtained by controlling this impingement air. A mechanically set orifice would provide a set minimum air flow. The electronically controlled orifice would be controlled by the ECU to obtain the proper idle speed.

Of course, the use of natural aspiration described above would provide progressively less impingement air as the load (manifold pressure) of the engine increases. In another embodiment of the invention, which would overcome such a limitation of this device, impingement air is delivered to the fuel rail by an air pump, which would allow for the impingement air to be delivered under all engine operating conditions, independently of the intake manifold pressure.

An internal combustion engine requires a certain amount (mass) of air to sustain idle, which is normally achieved by providing a variable, electronically-controlled orifice having its inlet in the throttle body and its outlet on the engine bottom side of the throttle valve in the manifold or throttle body. It is important to note that the air which sustains idle is currently simply routed back into the induction system where it eventually gets drawn into the individual cylinders.

This invention contemplates that a major benefit in fuel preparation can be achieved by strategically routing the idle air so that it impinges the fuel as it exits the fuel injector(s) so that the kinetic energy of the air will further atomize the fuel, resulting in better idle quality, emissions and combustion.

A further packaging advantage enabled by this invention is that the variable orifice (usually a stepper motor device) can be part of the fuel rail assembly, for example.

These and various other general and specific objects, aspects and advantages of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views.

DETAILED DESCRIPTION OF THE PREFERRED EMBODIMENTS

Figure 1:
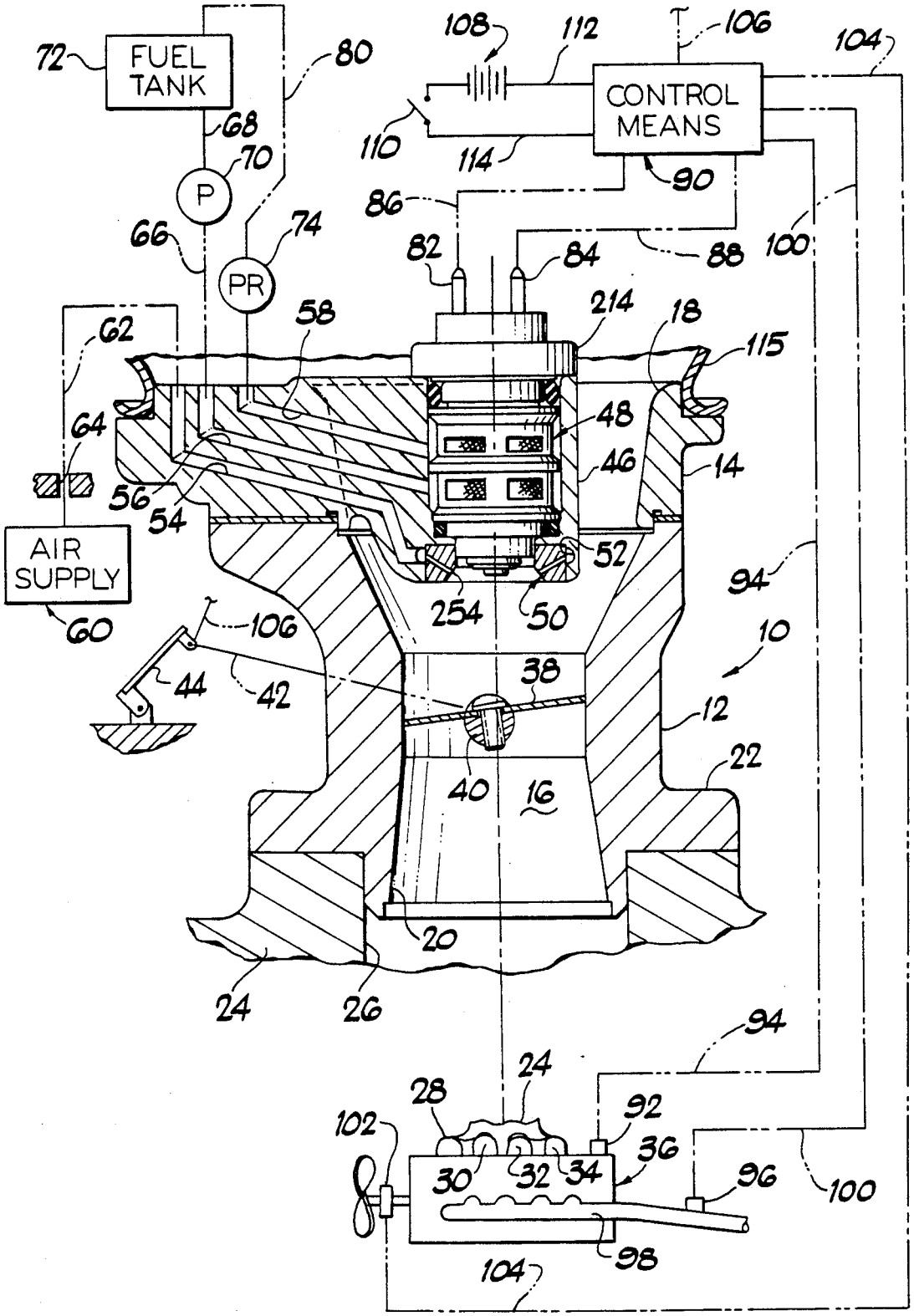
FIG. 1 is a generally axial cross-sectional view through a somewhat simplified throttle body carrying a fuel injector assembly air supply passage means, employing teachings of the inventions, shown in association with a generally schematically depicted engine and related operating structure.

Referring now in greater detail to the drawings, FIG. 1 illustrates a throttle body assembly 10 having a lower body means 12 and an upper body means 14 through which is formed suitable induction passage means 16 having an inlet end 18 and a discharge end 20. The lower body means 12 may be provided with a suitable flange 22 by which the assembly 10 is operatively secured to a cooperating intake or induction manifold 24 having main induction passage means 26 which, in turn, communicates with a plurality of manifold runners or branches 28, 30, 32 and 34 respectively leading to the intake valve means of the respective cylinders of a combustion engine 36.

Throttle valve means 38 situated within the induction passage means 16 and carried by throttle shaft means 40 is variably and selectively rotatably positionable within induction passage 16 as through suitable connecting or motion transmitting means 42 operatively interconnecting the throttle shaft 40 with the vehicle operator's foot-operated throttle pedal or lever 44.

A body portion 46, of upper body means 14, is depicted as extending somewhat into the induction passage 16 and serves as a mounting means for operatively holding a fuel injector assembly 48 therein. The lower portion of body portion 46 is generally open for the discharge of fuel from the injector assembly 48 and carries a generally annular or ring-like air discharge nozzle means 50. An annular passage 52 generally circumscribing the nozzle means 50 is illustrated as being formed in body portion 46.

Further, a plurality of passage or conduit means are depicted as being formed in body portion 46. More particularly, a first passage or conduit 54 is shown communicating with annular passage or conduit 52 while second and third passages or conduits 56 and 58 are each in communication with injector assembly 48. Conduit means 56 also communicates, as via conduit means 66 and 68 and pump means 70, with a fuel tank or reservoir 72. The pressure of the fuel supplied by pump 70 may be regulated as by pressure regulating means 74 in conduit means 80 communicating between conduit means 58 and the fuel tank or reservoir 72.

Conduit means 54 also communicates with a suitable source of air 60 as through associated conduit or passage means 62 which may also comprise suitable fixed or variable restriction means 64. For throttle body injection, wherein one or more injectors discharge metered fuel into an induction passage above the throttle valve plate 38, as in FIG. 1, the air supply source 60 must be an active device, such as an air pump or compressor supplying air at super-atmospheric pressure, since there is not sufficient pressure differential between atmospheric pressure and the pressure above the throttle plate for purposes of the invention.

The electrical terminal means 82 and 84 of the injector assembly 10 may be respectively electrically connected as via conductor means 86 and 88 to related electronic control means 90.

The control means 90 may comprise, for example, suitable electronic logic type control and power output means effective to receive one or more parameter type input signals and in response thereto produce related outputs. For example, engine temperature responsive transducer means 92 may provide a signal via transmission means 94 to control means 90 indicative of the engine temperature; sensor means 96 may sense the relative oxygen content of the engine exhaust gases (as within engine exhaust conduit means 98) and provide a signal indicative thereof via transmission means 100 to control means 90; engine speed responsive transducer means 102 may provide a signal indicative of engine speed via transmission means 104 to control means 90; while engine load, as indicated for example by the position of the engine induction system throttle vale means 38, may provide a signal as via transducer-transmission means 106 operatively connected to the engine operator's foot-actuated throttle pedal lever 44 and to control means 90. A source of electrical potential 108 along with related switch means 110 may be electrically connected as by conductor means 112 and 114 to control means 90.

Suitable inlet air cleaner means may be operatively connected to the inlet of induction passage means as fragmentarily depicted at 115.

Figure 2:
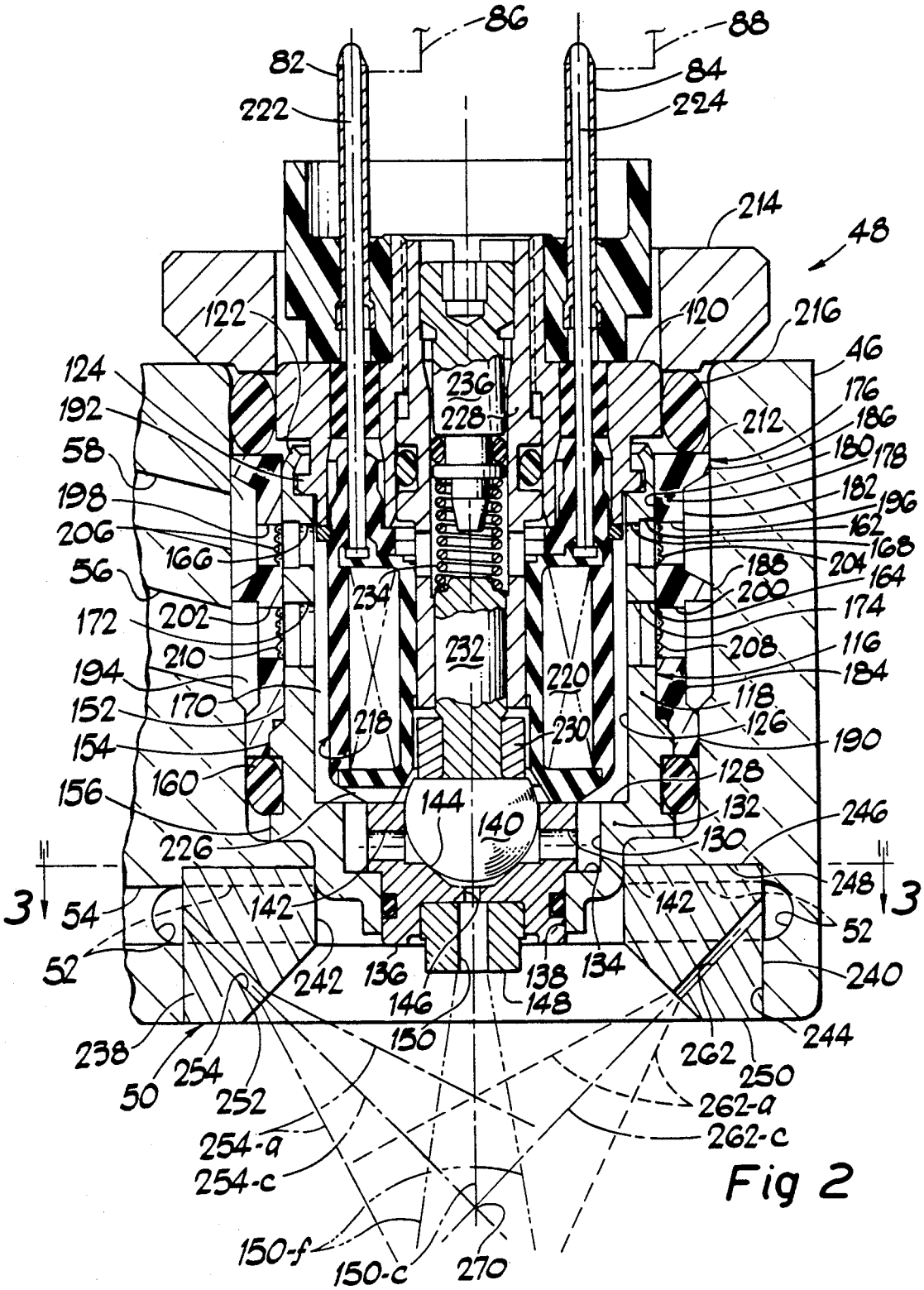
FIG. 2 is a relatively enlarged view of a fragmentary portion of the structure shown in FIG. 1 with the fuel injector assembly, of FIG. 1, being shown in axial cross-section.

Referring in greater detail to FIG. 2, the injector assembly 48 is illustrated as comprising housing means 116 which, in turn, comprises a lower generally tubular main body or housing portion 118 and an upper end closure 120 both of which are of magnetic material. The end closure member 120 may be secured to the lower main body 118 as by a rolled-over portion 122 of main body 118 pressed against a cooperating flange 124 of housing means closure member 120.

As generally depicted, the housing means body portion 118 may be provided with an axially extending inner cylindrical surface 126 which may terminate as in an annular flange-like or shoulder surface 128. A counterbore or axially extending recess 130 is formed in the lower transverse wall portion 132 of housing body 118 as to form a shoulder surface 134. A stepped generally cylindrical valve seat member 136 is pressed into a bore 138 to the point where its stepped annular surface abuts against shoulder surface 134.

The valve seat member 136 comprises a generally upwardly extending tubular wall having an inner cylindrical wall surface serving as an axial guide for an associated spherical valving member 140. A plurality of passages or orifices 142 formed through the tubular wall of member 136 enable fuel to flow therethrough. A generally concave valve seat 144 cooperates with valve member 140 to intermittently permit and terminate the flow of fuel from passages 142 to and through a metered fuel discharge passage 146. A nozzle-like insert 148, having a guide passage 150, may be pressed into valve seat member 136 as to assist in the direction of spray of the metered fuel exiting passage means 146.

The external surface 152 of housing means 116 is also of a generally cylindrical configuration and, among other things, is provided with annular flange-like portions 154 and 156 which cooperate to define an annular recess effective for receiving and holding an O-ring seal 160. Housing means 116 is also preferably provided with a plurality of axially spaced circumscribing annular recesses 162 and 164 formed in the outer cylindrical surface thereof. A first plurality of generally radially directed angularly spaced apertures or passages, two of which are shown at 166 and 168, are formed through housing body 118 and serve to complete communication as between annular recess 162 and the interior 170 of housing means 116. A second plurality of generally radially directed angularly spaced apertures or passages, two of which are shown at 172 and 174, are formed through housing body 118 and serve to complete communication as between annular recess 164 and the interior 170 of housing or body means 116.

A filter assembly 176 is illustrated as being comprises of a generally tubular body 178 of cylindrical configuration having its inner cylindrical surface 180 received at least closely against the outer surface of housing body 118. Preferably, the body 178 is comprised of nylon resin.

The upper end (as viewed in FIG. 2) of filter body 178 is open as to permit, for example, the extension therethrough of the upper end of housing body 118 as well as the end member 120. Filter body 178 is also preferably provided with a plurality of axially spaced circumscribing annular recesses 182 and 184 formed in the outer cylindrical surface thereof thereby defining annular flange-like portions 186, 188 and 190. When received within related support structure, body portion 46, a first annular chamber or passage 192 is formed generally by recess 182, flanges 186 and 188 and the interior of the support structure 46; similarly a second annular chamber or passage 194 is formed generally by recess 184, flanges 188 and 190 and the interior of the support structure 46.

A first plurality of generally radially directed angularly spaced apertures or passages, two of which are shown at 196 and 198, are formed through filter body 178 and serve to complete communication as between annular passage 192 and annular recess or passage 162. A second plurality of generally radially directed angularly spaced apertures or passages, two of which are shown at 200 and 202, are formed through filter body 178 and serve to complete communication as between annular passage 194 and annular recess or passage 172. The plurality of passages, as typified by passages 196 and 198, are respectively provided with filter screen means as typically respectively illustrated at 204 and 206 of passages 196 and 198. Similarly, the plurality of passages, as typified by passages 200 and 202, are respectively provided with filter screen means as typically respectively illustrated at 208 and 210 of passages 200 and 202.

The upper end of filter assembly 176 terminates as at an upper annular surface 212 of flange 186 and is axially spaced from an upper situated dielectric end cover or retainer member 214 which is effective to retain the injector assembly 48 assembled to the support structure 46. An O-ring seal 216 is axially confined between surface 212 and retainer member 214 and annularly compressed as between the outer cylindrical surface of housing end member 120 and the juxtaposed surface of support structure 46.

A generally toroidal bobbin body 218 situated within housing body means 118 contains an electrical coil 220 the respective electrical ends of which are electrically connected to upwardly extending pins or rods 222 and 224 which, in turn, are received in contacting engagement within terminals 82 and 84, respectively. The bobbin body 218 may be provided with a plurality of foot-like portions 226 which may be brought into engagement with the upper end of the tubular wall of valve seat member 136.

A generally tubular pole piece 228, threadably engaged at its upper portion with the housing end member 120, extends downwardly into and within the radially inner wall of bobbin body 218 as to have its annular pole piece end face juxtaposed to and spaced from the upper annular surface of a first ring-like armature means 230 when the valve member 140 is seated against valve seating surface means 144. The threadable engagement of the pole piece 228 with end member 120 enables the axial adjustment of the pole piece 228 to obtain a selected gap between the pole piece end face and the upper annular surface or face of ring-like armature means 230 when the valve member 140 is seated.

A guide pin 232, of preferably non-magnetic material, is slidably received within the core or pole piece 228 and carries, as at the lower end thereof, the ring-like armature means 230 for movement in unison therewith. The guide pin 232 is normally resiliently urged downwardly (as viewed in FIG. 2) against valve 140 (which also acts as an armature means) to urge valve 140 into seated engagement with valve seat means 144.

A spring 234 received as within the bore of pole piece means 228 is axially contained between and against the guide pin 232 and one end of a spring adjuster screw 236 which is threadably engaged with pole piece means 228 and suitably sealed as by 0-rings to prevent leakage therepast as is well known in the art. The purpose of such spring adjuster screw 236 is, of course, as is well known in the art, to attain the desired spring pre-load on guide pin 232 and valve 140.

Figure 3:
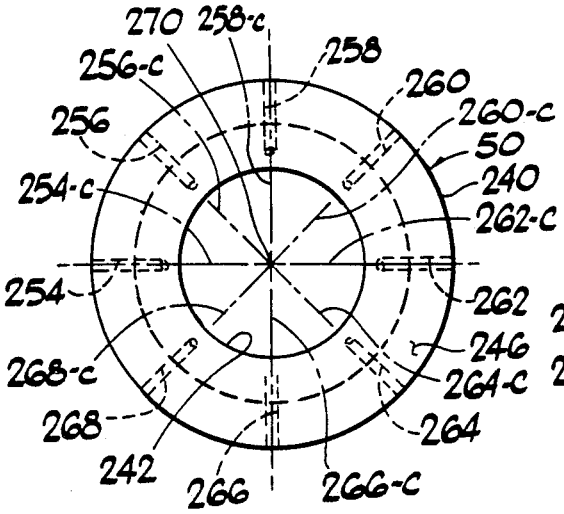
FIG. 3 is a view, in reduced scale, of one of the elements in FIGS. 1 and 2, taken generally one the plane of line 3—3 of FIG. 2 and looking in the direction of the arrows.

Referring to each of FIGS. 1, 2 and 3, the air nozzle means 50 is illustrated as comprising an annular or ring-like nozzle body 238 having an outer cylindrical surface 240 and an inner cylindrical surface 242. The nozzle body 238 is illustrated as being received and retained within a counterbore 244 formed in body portion 46, as by, for example, a press-fit between outer surface 240 and bore or recess 244. An upper annular surface 246 of body 238 is shown seated against the transverse surface 248 of bore 244 while a lower annular surface 250 of body 238 is depicted as being generally coplanar with the lower end of body or support structure 46.

Although not so limited, in the preferred embodiment shown, a generally conical surface portion 252, in the order of 90° included angle, serves to span the distance from inner cylindrical surface 242 to the lower annular surface 250. Further, as depicted in FIGS. 1 and 2, the inner cylindrical surface 242 may closely receive therein at least a portion of the downwardly depending end of injector body means 118.

A plurality of nozzles or nozzle passages 254, 256, 258, 260, 262, 264, 266 and 268 are formed through nozzle means body 238. In the embodiment depicted in FIG. 2, all of such nozzles 254–268 are formed as to be at the same angle, as for example 45°, with respect to the horizontal and perpendicular to the surface 252 as viewed in FIG. 2 and radial as viewed in FIG. 3.

In the embodiment of FIG. 2, the pattern of air flow from nozzle 254 is depicted as being generally conical and as existing primarily between lines 254-*a* while the general central axis of such flow is depicted by line 254-*c*. Similarly, the pattern of air flow from nozzle 262 is depicted as being generally conical and as existing primarily between lines 262-*a* while the general central axis of such flow is depicted by line 262-*c*. Such air flow patterns may be considered as typical for all of such nozzles 256, 258, 260, 264, 266 and 268 shown in FIG. 3. Further, although other variations are contemplated, the respective central axes, 256-*c*, 258-*c*, 260-*c*, 264-*c*, 266-*c* and 268-*c*, of such nozzles meet as at a point 270 as depicted in both FIGS. 2 and 3.

Further, referring primarily to FIG. 2, the spray pattern of the fuel being injected as depicted as being generally conical and as existing primarily between lines 150-*f* while the general central axis of such fuel spray is depicted by line 150-c. In this arrangement, it is contemplated that the axes of air flow and the axis of fuel spray would, substantially, intersect at point 270.

Operation of the Apparatus of FIGS. 1, 2 and 3

With particular reference to FIGS. 1 and 2, the fuel pump means 70 (which may be mounted internally of fuel tank 72) supplies fuel under superatmospheric pressure via conduit means 66 and 56 to annular chamber 194 from where such fuel flows through the plurality of ports or passages 200 and 202 (which may be only two of many), through the filter means 208 and 210 and into annulus 164 of housing body means 118 from where, in turn, such fuel flows into the interior space 170 as via the plurality of ports or passages 172 and 174 (which also may be only two of many). Any excess fuel is returned to the fuel reservoir or tank 72 as via conduit means 58 communicating with annulus 192 and serially connected to suitable pressure regulating means 74 and return conduit means 80. Any fuel vapors which may occur within the assembly 48 flow out and return as to fuel tank 72 as via conduit means 58 and 80.

The fuel under superatmospheric pressure thusly provided to cavity or space 170 of course also flows through the spaces between the plurality of legs 226 and through the bore 130 and passages 142 as to generally surround the armature ball valve 140. As the armature valve 140 is moved upwardly off its cooperating seat 144, fuel passes between the opened valve 140 and seat 144 and into passage 146 from where it is discharged as via nozzle discharge passage means 150 into induction passage means 16.

As depicted in FIG. 1, the terminal means 82 and 84 may be respectively electrically connected as via conductor means 86 and 88 to related electronic control means 90 and, as should already be apparent, the illustrated metering means 48 is of the duty-cycle type wherein the winding or coil means 220 is intermittently energized thereby causing, during such energization, armature valve member 140 to move in a direction away from valve seat 144. Consequently, the effective flow area of the flow orifice thusly cooperatively defined by the armature valve member 140 and valve seat 144 can be variably and controllably determined by controlling the frequency and/or duration of the energization of coil means 220.

The control means 90 may comprise, for example, suitable electronic logic type control and power output means effective to receive one or more parameter type input signals, as previously described, and in response thereto produce related outputs. The rate of metered fuel flow, in the embodiment disclosed, will be dependent upon the relative percentage of time, during an arbitrary cycle time or elapsed time, that the valve member 140 is relatively close to or seated against seat 144 as compared to the percentage of time that the valve member 140 is opened or away from the cooperating valve seat 144.

This is dependent on the output to coil means 220 from control means 90 which, in turn, is dependent on the various parameter signals received by the control means 90. For example, if the oxygen sensor and transducer means 96 senses the need of a further fuel enrichment in the motive fluid being supplied to the engine and transmits a signal reflective thereof to the control means 90, the control means 90, in turn, will require that the metering valve 140 be opened a greater percentage of time as to provide the necessary increased rate of metered fuel flow. Accordingly, it will be understood that given any selected parameters and/or indicia of engine operation and/or ambient conditions, the control means 90 will respond to the signals generated thereby and respond as by providing appropriate energization and de-energization of coil means 220 (causing corresponding movement of valve member 140) thereby achieving the then required metered rate of fuel flow to the engine 36 via induction passage means 16.

More particularly, assuming that the coil means 220 is in its de-energized state, spring 234 will urge the guide pin 232 (which is axially slidable within core or pole piece means 228) downwardly causing the guide pin 232 and armature means 230 to urge against the flatted surface of armature valve 140 and hold the valve 140 in a sealed seating engagement with seat means 144 thereby preventing fuel flow therepast into conduit 146.

When coil means 220 becomes energized a magnetic flux is generated and such flux path includes armature valve 140, armature means 230 and core or pole piece means 228. As a consequence of such flux field, armature valve 140 and armature means 230 are drawn upwardly moving guide pin 232 against the resilient resistance of spring means 234. Such upward movement of the armature valve 140 continues until, for example, the upper surface of armature means 230 abuts against the pole piece end face.

When the energization of field coil means 220 is terminated, spring 234, through guide pin 232, moves the valve member downwardly through its down stroke until the valve 140 is sealingly seated against cooperating seating surface means 144.

As the fuel is being metered and injected, as described, air, coming form a suitable source of air 60, flows through conduit means 62 and 54 into the generally circumscribing manifold-like passage 52 and then flows out of the air nozzles 254, 256, 258, 260, 262, 264, 266 and 268, as in the manner depicted in and described with reference to FIGS. 2 and 3. The air thusly supplied by the said air nozzles impinges upon the metered fuel spray 150-*f* and the impact thereof serves to cause the fuel droplets within the metered fuel spray 150-*f* to be broken into smaller droplets thereby improving the atomization of the metered fuel and improving the quality of the subsequent combustion within the engine combustion chambers.

As, and for the reasons, already stated above, the air source 60 for the throttle body injection system of FIG. 1 must be an air pump supplying super-atmospheric air pressure.

The invention, as disclosed, contemplates various other embodiments and modifications. For example, referring to FIGS. 2, 3 and 4, it is contemplated that the air nozzle means 50 of FIGS. 2 and 3 may be modified as to comprise a configuration as that depicted in FIG. 4. For each of disclosure, all elements and/or details in FIG. 4 which are like or similar to those of FIGS. 2 and 3 are identified with like primed, reference numerals.

Figure 4:
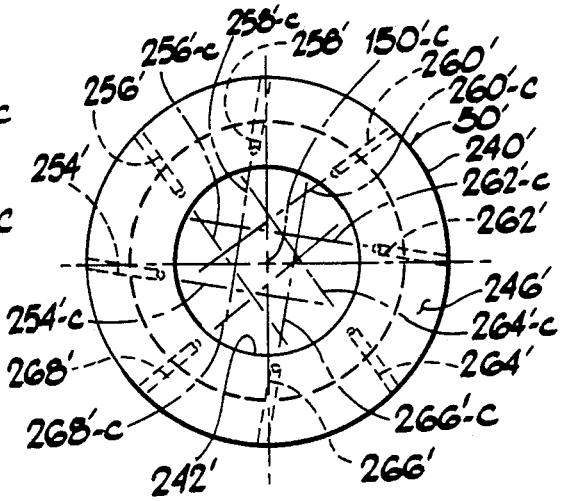
FIG. 4 is a view similar to that of FIG. 3 but illustrating another embodiment or modification of the structure of FIG. 3.

For purposes of description, the various nozzles 254' through 268' may be considered as being inclined to the horizontal at 45° relative thereto, much as described with reference to FIG. 2; however, as seen in FIG. 4 the respective nozzles 254'–268' are positioned as to have their respective axes (254'*c*–268'-*c*) skew with respect to the axis of the nozzle means 50' and to the axis 150'-*c* of the spray of metered fuel. By positioning the respective air nozzles 254' through 268' in the manner depicted in FIG. 4, the resulting skewed flow of air impinging upon the spray of metered fuel would at least tend to induce a spiral effect on the spray of metered fuel and thereby possibly further enhance the atomization of the metered fuel.

Figure 5:
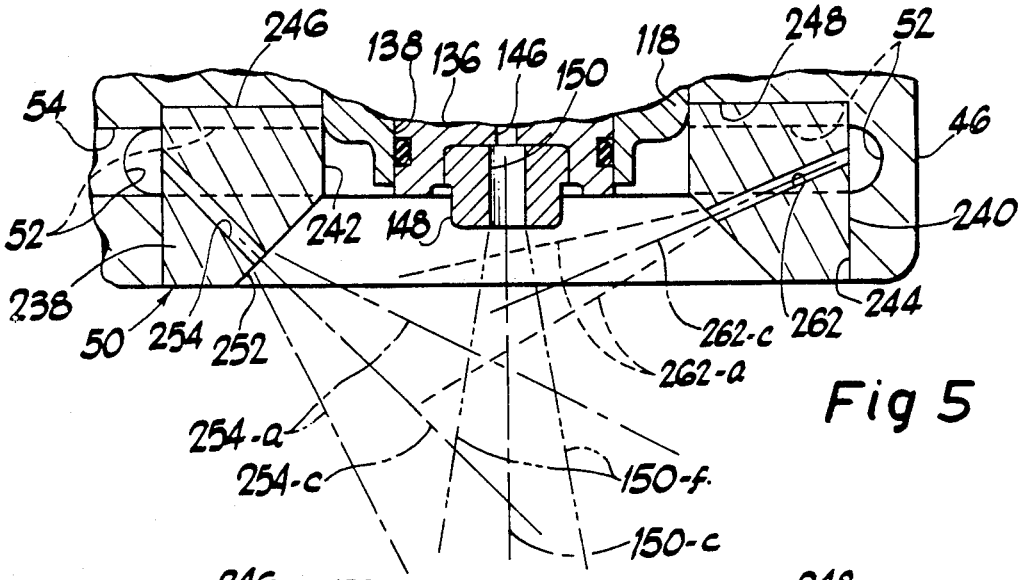
FIG. 5 is a cross-sectional view, illustrating a fragmentary portion of the structure of FIG. 2 and depicting a further embodiment or modification thereof.

FIG. 5 illustrates a further modification of the invention. In FIG. 5 all elements and/or details which are like or similar to those of FIGS. 2 and 3 are identified with like reference numbers. Referring in greater detail to the embodiment of FIG. 5, it can be seen that even though the air nozzle 254 is positioned substantially as shown in FIG. 2, certain others of the air nozzles, as depicted by air nozzle 262 have their relative angular position, with respect to the horizontal (as viewed in FIG. 5) changed (as compared to FIG. 2) so that the flow of air, 262-*a*, impinges upon the spray of metered fuel, 150-*f*, at a location which is relatively upstream of where the flow of air, 254-*a*, in the main, impinges upon the spray of metered fuel flow 150-*f*. The embodiment of FIG. 5 contemplates the various possibilities of having either: (1) alternate air nozzles inclined at differing angles with respect to the horizontal; (2) a selected one or a number of air nozzles, not necessarily all being alternate air nozzles, inclined at angles, with respect to the horizontal, differing from the angle of inclination of the remaining air nozzles whereby the spray of metered fuel is impinged upon, are various relative upstream and downstream portions thereof, by the air flows from such air nozzles. It should also be brought out that some of the air nozzles may be skew to the main axis of the nozzle means as shown in FIG. 4, while other of the air nozzles may be radial and directed toward the main axis of the nozzle means as shown in FIG. 3, and, further, such air nozzles may, in turn, be aimed at various relative upstream and downstream portions of the spray of metered fuel as shown in and described with reference to FIG. 5.

Figure 6:
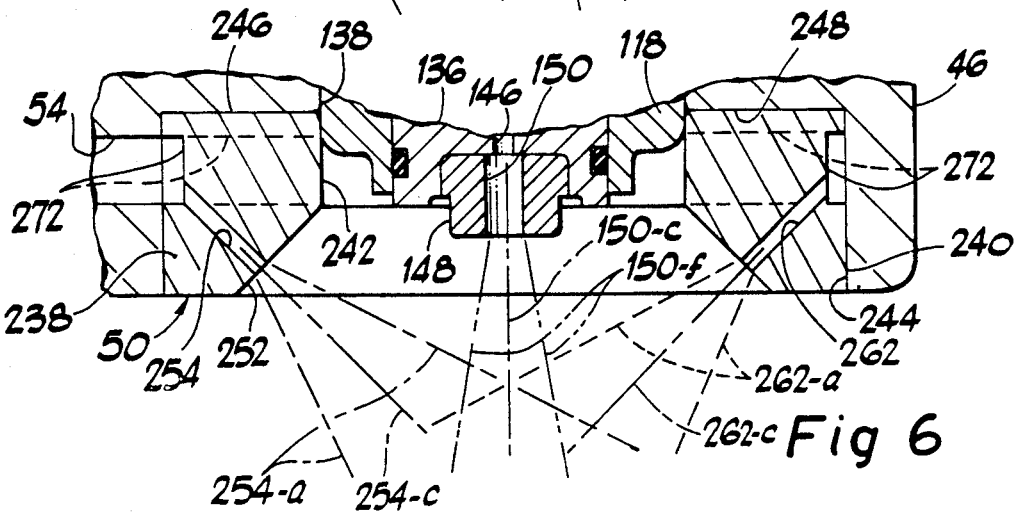
FIG. 6 is a cross-sectional view generally similar to that of FIG. 5 but illustrating an additional modification.

FIG. 6 illustrates yet another modification. In FIG. 6 all elements and/or details which are like or similar to those of FIG. 2 are identified with like reference numbers. Referring in greater detail to the embodiment of FIG. 6, it can be seen that instead of the annular manifold-like passage or conduit means 52, formed in body portion 46, the nozzle means 50 is provided with a groove or recess 272 formed generally in the periphery thereof forming a generally circumscribing manifold-like passage which, in turn, communicates with conduit 54 and each of the air nozzles as typically depicted by air nozzles 254 and 262. Any of the embodiments described herein could, of course, employ a manifold 272 formed into the air nozzle means 50.

Figure 7:
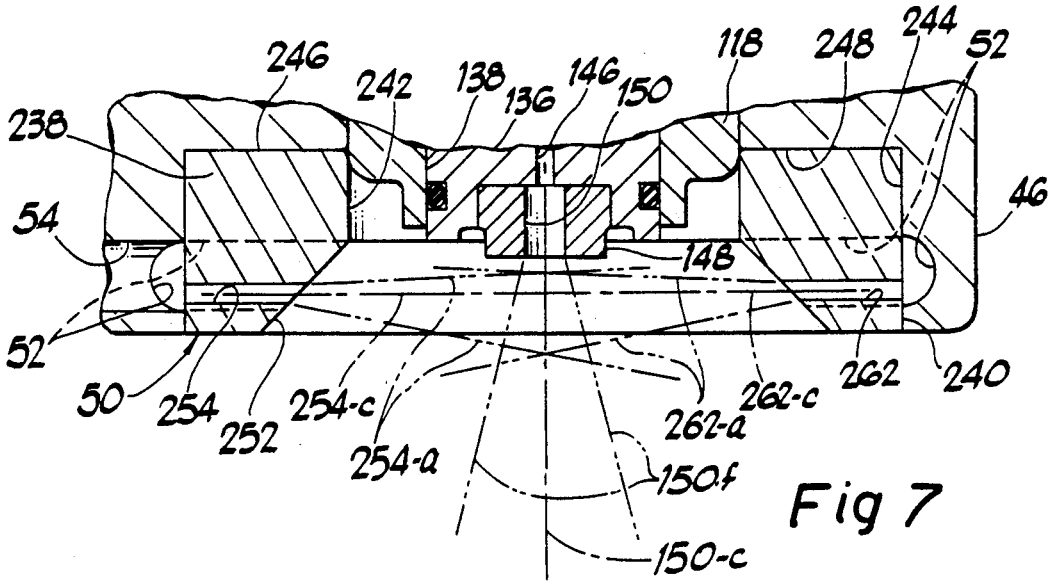
FIGS. 7 and 8 are each views similar to FIG. 5 and respectively illustrating still further embodiments or modifications of the invention.

FIG. 7 illustrates a further modification of the invention. In FIG. 7 all elements and/or details which are like or similar to those of FIGS. 2 and 3 are identified with like reference numbers. Referring in greater detail to the embodiment of FIG. 7, it can be seen that the main difference as between FIGS. 2 and 7 is that at least certain of the air nozzles, as depicted by air nozzles 254 and 262 of FIG. 7, are positioned as to have a generally horizontal direction of discharge which, in turn, would make such generally normal to the axis 150-C of the spray of metered fuel 150-*f*. It is contemplated that in the embodiment depicted in FIG. 7, either only a certain select number of air nozzles or all of such air nozzles may be positioned as to have generally horizontal directions of discharge (as depicted by air nozzles 254 and 262). Further, such horizontal-discharge air nozzles of FIG. 7 may be oriented in accordance with the teachings herein presented with respect to FIG. 4 and/or FIG. 6.

Figure 8:
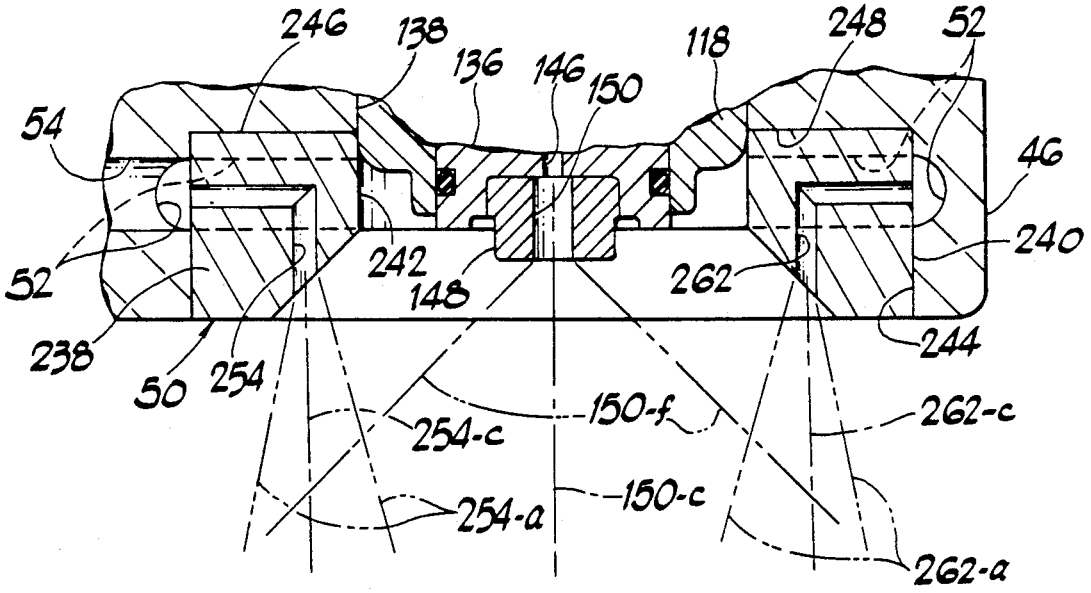

FIG. 8 illustrates yet another modification of the invention. In FIG. 8 all elements and/or details which are like or similar to those of FIGS. 2 and 3 are identified with like reference numbers. Referring in greater detail to the embodiment of FIG. 8, it can be seen that the main difference as between FIGS. 2 and 8 is that at least certain of the air nozzles, as depicted by air nozzles 254 and 262 of FIG. 8, are positioned and/or formed as to have a path of discharge somewhat parallel to the axis 150-*c* of the spray of metered fuel 150-*f*. It is contemplated that in the embodiment depicted in FIG. 8, either only a certain select number of air nozzles or all of such air nozzles may be positioned as to have directions of air discharge as that depicted by 254 and 262 of FIG. 8.

Figure 10:
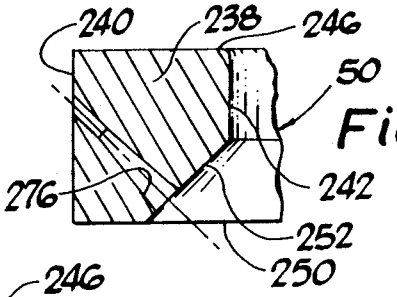
FIGS. 9, 10 and 11 are each cross-sectional views of a fragmentary portion of the structure shown in any of FIGS. 2, 5, 6, 7 and 8 but respectively illustrating further modifications or embodiments thereof.
Figure 11:
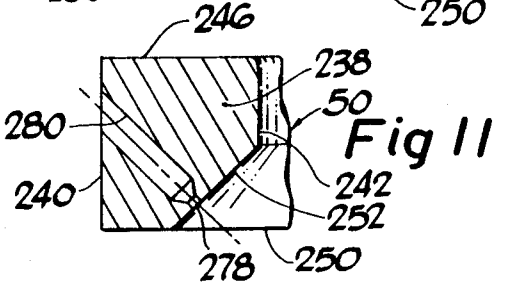
Figure 9:
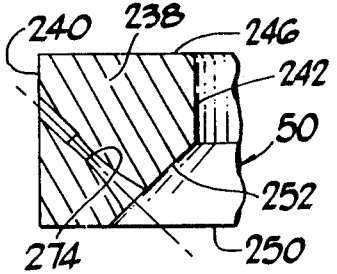

FIGS. 9, 10 and 11 illustrate selected ones of further modifications and/or embodiments of the air nozzles employable in air nozzle means 50 and/or 50'. All elements in any of FIGS. 9, 10 and 11 which are like or similar to those of, for example, FIGS. 5, 6, 7 and 8 are, with noted exceptions, identified with like reference numbers. Referring in greater detail to FIGS. 9, 10 and 11, FIG. 9 illustrates that one or more nozzles of the nozzle means 50 may be configured in the form of a venturi as generally typically depicted at 274. FIG. 10 illustrates that one or more nozzles of the nozzle means 50 may comprise a configuration of a divergent cone as generally typically depicted at 276, while FIG. 11 illustrates that one or more nozzles of the nozzle means 50 may comprise an orifice, as generally typically depicted at 278, and a relatively enlarged upstream passageway 280 in communication therewith.

Figures 12, 12A:
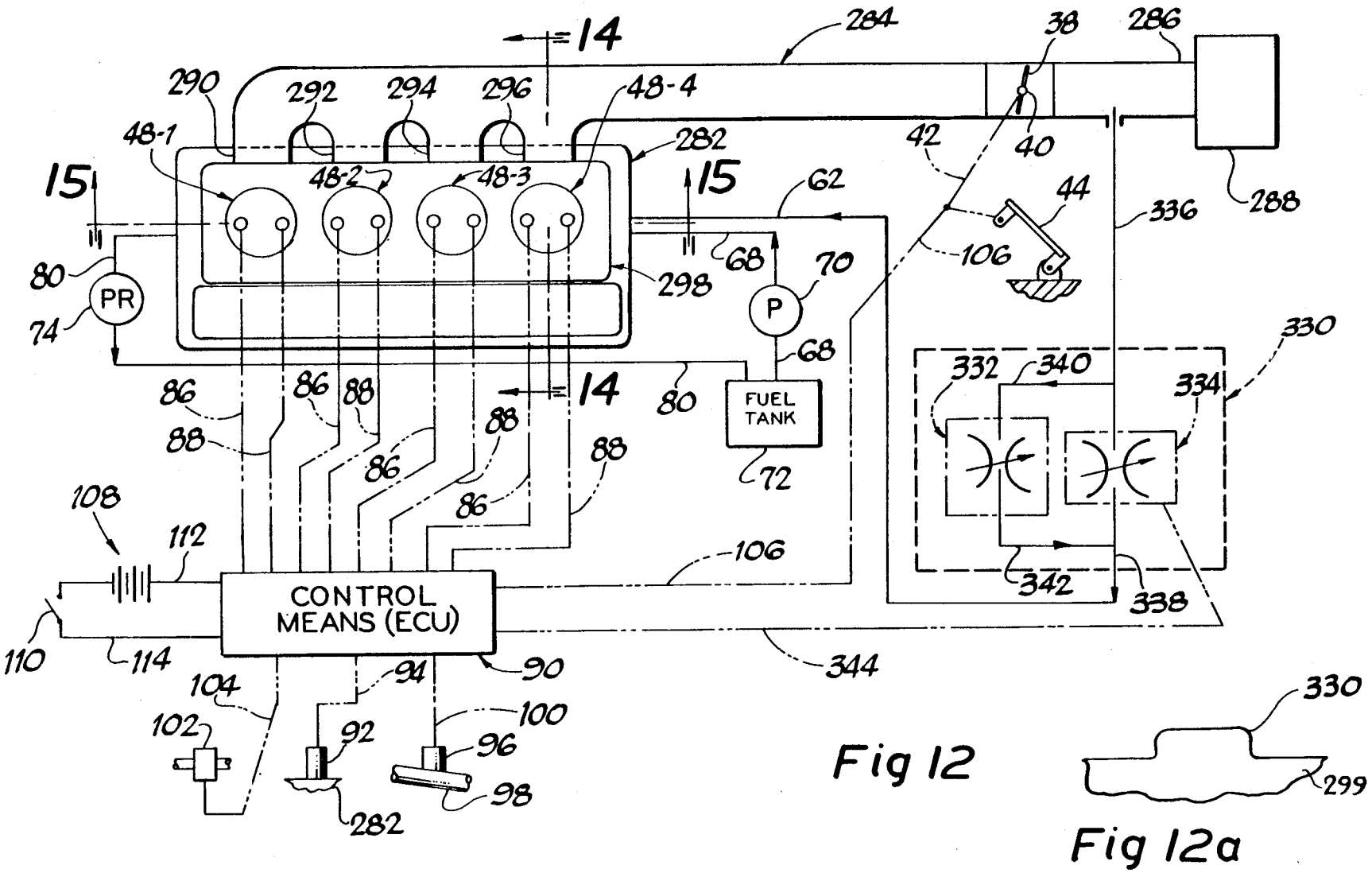
FIG. 12 is a view, partly diagrammatic and partly schematic, of an overall engine assembly and associated controls employing teachings of the invention.
FIG. 12*a* is a fragmentary view illustrating modification of the invention.

FIG. 12 illustrates an engine 282, which may be not unlike that at 36 of FIG. 1, with induction passage means 284 for supplying air to said engine 282. The induction passage means 284 is depicted as comprising an inlet end 286, with suitable inlet air cleaner means 288 operatively connected thereto, and a plurality of induction runners or branches 290, 292, 294 and 296 effective for respectively communicating with the respective engine cylinders or combustion chambers which, for purposes of disclosure, are assumed to be a total of four. Other various elements and/or details in FIG. 12 which are like or similar to any of the elements and/or details of preceding Figures are identified with like reference numbers and the operations thereof, except as may be noted to the contrary, would be like or similar in the embodiment of FIG. 12.

In the embodiment of FIG. 12 a plurality of fuel injectors 48, of a number corresponding but not limited to the number of engine cylinders, are employed and for ease of reference, such injectors are respectively numbered 48-1, 48-2, 48-3 and 48-4. As will be noted each of said injectors has its electrical terminals electrically connected to the electronic control unit (ECU) or control means 90 by respective pairs of conductor means 86 and 88 so that the operation thereof is as described, for example, with regard to FIG. 2. Still with reference to FIG. 12, the metering valving assemblies or injector assemblies 48-1, 48-2, 48-3 and 48-4 are depicted as being operationally mounted in or carried by suitable body means or support structure 298, which, as contemplated by the invention, may comprise a fuel rail, for example, as shown in FIG. 14.

Figure 14:
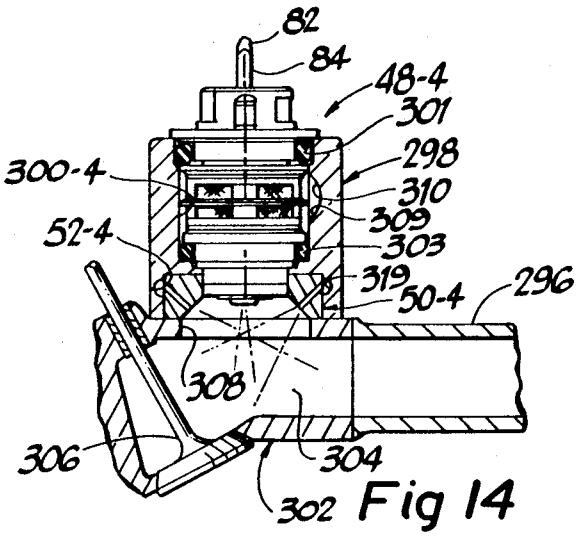
FIG. 14, appearing on the same drawing sheet as FIGS. 9, 10 and 11, is a relatively enlarged cross-sectional view taken generally on the plane of line 14—14 of either FIG. 12, FIG. 13 or FIG. 16 and looking in the direction of the arrows.
Figure 15:
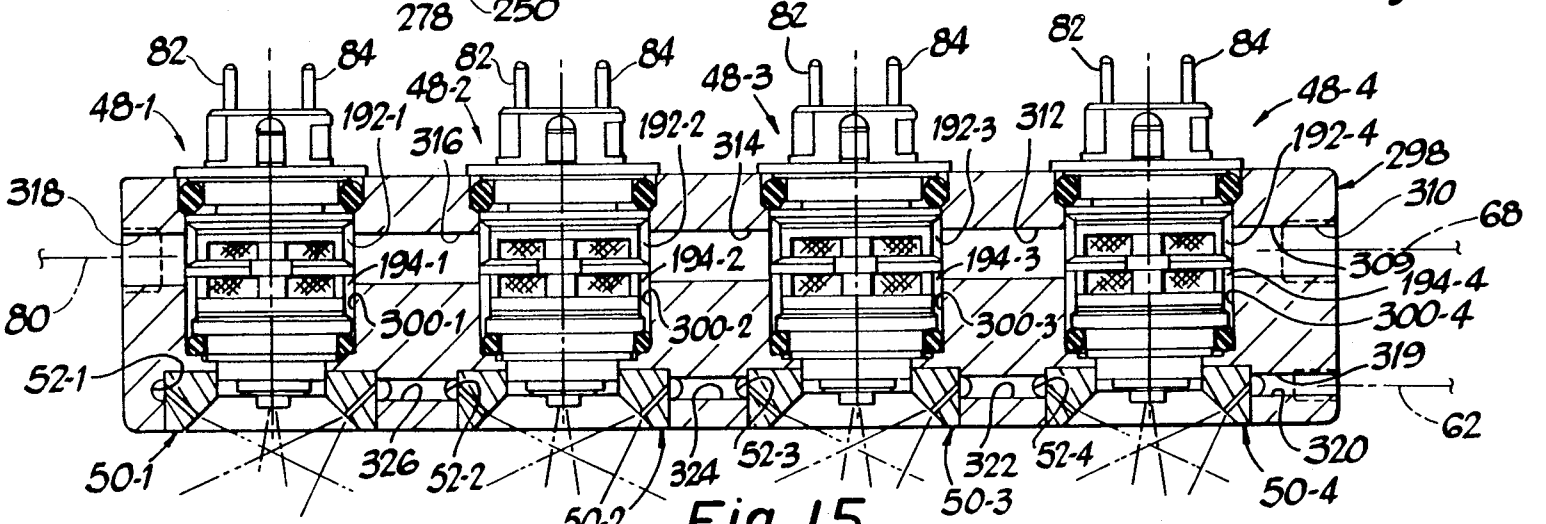
FIG. 15 is a relatively enlarged cross-sectional view taken generally on the plane of line 15—15 of either FIG. 12, FIG. 13 or FIG. 16 and looking in the direction of the arrows.

Before considering, in detail, the structure as shown in FIGS. 14 and 15, it should be noted that at least certain of the elements and/or details thereof which are like or similar to, for example, FIGS. 1 and 2 are identified with like reference numbers and that, as in the case of the injector assemblies 48-1, 48-2, 48-3 and 48-4, where a plurality of such elements and/or details are shown, certain of these, too, are provided with a following "dash" number for ease of identification.

As depicted in somewhat simplified manner in FIG. 14, typically, the metering or injector assembly 48-4 is shown sealingly received and secured (as by O-ring seals 301 and 303) in a cooperating bore or cup 300-4 formed in a fuel rail structure 298. The fuel rail structure or body 298, in turn, may be suitably secured to additional structure 302 which, in the assumed condition, may comprise four separate (non-communicating) passages or conduits one of which is shown at 304. The structure 302 may be secured to the engine block as to have the intake valve at 306 open and close, in timed relationship to engine operation, as to, when opened, permit the flow of combustible motive fluid therepast and into the combustion chamber of the associated engine cylinder. As shown, the induction passage branch or runner 296 communicates only with passage 304 and the other branches or runners 290, 292 and 294 would, similarly, communicate only with the respective passages, functionally equivalent to passage 304, and respectively associated with injector assemblies 48-1, 48-2 and 48-3 and, in turn, the respective engine cylinders associated therewith. As typically illustrated in FIG. 14, the structure 302 is preferably provided with an aperture or passageway 308 which permits the flow therethrough of metered fuel (from injector assembly 48-4) and the air (that is provided by the nozzle means 50-4) into the induction passage (as may be comprised of passage 304) to be sprayed or discharged in close proximity to the related engine intake valve means 306. An orifice or passageway, functionally equivalent to passage means 308, is similarly provided in structure 302 for each of the injector assemblies 48-1, 48-2 and 48-3.

Figure 15A:
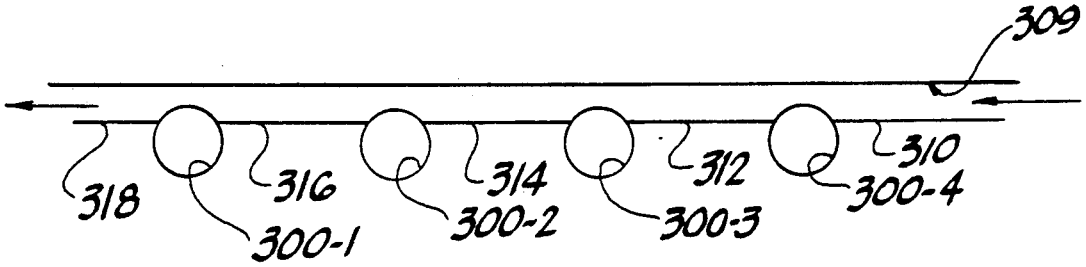
FIG. 15*a* is a schematic plan view of the fuel passage of FIG. 15.

Referring in greater detail to FIGS. 14, 15 and 15*a*, a main simple and continuous fuel passage way 309 is shown formed in fuel rail structure 298, tangentially intersecting and feeding each of the receiving cups 300, injector and may be described, for purposes of illustration, as comprised of a plurality of aligned passageway 309 segments or conduits 310, 312, 314, 316 and 318. That is, as seen in FIGS. 14 and 15*a*, fuel passage 309 extends along the entire length of fuel rail 298 in communication between pump 70 and pressure regulator 74, while branch conduit section 310 of passageway 309 communicates with fuel supply conduit 68 and with the chamber 300-4; branch conduit section 312 communicates between chambers 300-4 and 300-3; branch conduit section 314 communicates between chambers 300-3 and 300-2; and branch conduit 316 communicates between chambers 300-2 and 300-1, while branch conduit section 318 of passageway 309 communicates between chamber 300-1 and fuel return conduit means 80. Chambers 300-1, 300-2, 300-3 and 300-4 are each, of course, functionally equivalent to the chamber formed in body portion 46 receiving the injector assembly 48 as illustrated in and described with reference to FIG. 2.

The passageway 309 is a continuous passage, with branch conduits, rather than separate conduits between the injector cups so as to minimize or eliminate fuel pressure drops that would occur at each cup. For equal fuel at each cylinder, as is required, the fuel pressure must be equal at all injector cups.

Referring for the moment to FIG. 2, it will be remembered that a first annulus 192 and a second annulus 194 (and their functions) were described as being defined generally by the surface of the chamber receiving the injector assembly 48 and the juxtaposed spaced surfaces of generally tubular body 176. (In FIG. 15, the annuli 192-1, 192-2, 192-3 and 192-4 are, each, functionally equivalent to annulus 192 of FIG. 2 and the annuli 194-1, 194-2, 194-3 and 194-4 are, each, functionally equivalent to annulus 194 of FIG. 2.) In FIG. 2, communication between annuli 194 and 192 could exist only by flow of fuel from annulus 194 through filters 208 and 210, into cavity or space 170 and then have any excess of fuel exit via filters 204 and 206 into annulus 192.

In contrast, and referring in greater detail to FIG. 15: conduit section 310 is so situated that in communicating with chamber 300-4 it communicates with both annuli 192-4 and 194-4; conduit section 312, similarly, communicates with both annuli 192-4 and 194-4 of chamber 300-4 and with both annuli 192-3 and 194-3 of chamber 300-3; conduit section 314, similarly, communicates with both annuli 192-3 and 194-3 of chamber 300-3 and with both annuli 192-2 and 194-2 of chamber 300-2; conduit section 316, similarly, communicates with both annuli 192-2 and 194-2 and with both annuli 192-1 and 194-1, while conduit section 318, similarly, communicates with both annuli 192-1 and 194-1 and with excess fuel return conduit means 80.

As a consequence of the foregoing, and in view of FIG. 12, it can be seen that fuel under superatmospheric pressure, delivered by pump means 70, is supplied via conduit means 68 to conduit 310 which directs all of such fuel to fuel metering or injector means 48-4 with the then excess of fuel being directed from annuli 192-4 and 194-4 into conduit 312 which, in turn, directs such fuel to fuel metering or injector means 48-3 with the then excess of fuel being directed from annuli 192-3 and 194-3 into conduit 314 which, in turn, directs such fuel to fuel metering or injector means 48-2 with the then excess of fuel being directed from annuli 192-2 and 194-2 into conduit 316 which, in turn, directs such fuel to fuel metering or injector means 48-1 with the then excess of fuel being directed into conduit 318 from where it flows through return conduit 80 and pressure regulator means 74 as to fuel tank or reservoir means 72.

It should now be apparent that any fuel vapors within either the fuel conduit means (comprised of 310, 312, 314 and 316) and/or within the injector assemblies 48-1, 48-2, 48-3 and 48-4 as well as the respective annuli will be swept by the fuel flowing therethrough and being, in part, returned to an area upstream of fuel pump means 70.

Figure 15B:
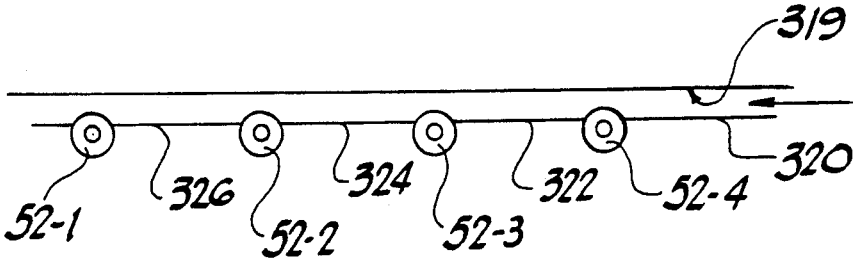
FIG. 15*b* is a schematic plan view, similar to FIG. 15*a*, of the air passage of FIG. 15.

Referring to FIGS. 14, 15 and 15*b*, the fuel rail structure 298 is shown as also being provided with a single continuous air passage 319, comprised of conduit sections 320, 322, 324 and 326, which are preferably formed in alignment with each other, in much the same manner, and for the same reasons (to avoid pressure drops across the annular manifolds) as in the case of fuel passageway 309. That is, conduit section 320 communicates with air supply conduit means 62 and with the annular manifold or distribution passage 52-4; conduit section 322 communicates between annular manifolds or distribution passages 52-4 and 52-3; conduit section 324 communicates between annular manifolds or distribution passages 52-3 and 52-2; and conduit section 326 communicates between annular manifolds or distribution passages 52-2 and 52-1. In certain Figures, the fuel conduit sections 310-318 and the air conduit sections 320, 322, 324 and 326 are illustrated as being positioned as to have their axes passing through the axes of injector assemblies 48-4, 48-3, 48-2 and 48-1; however, such conduit sections preferably comprise single continuous passages which, in turn, either have respective conduit branches communicating with the cups or manifolds or, in effect, tangentially intersect the same.

Operation of the Apparatus of FIGS. 12, 13, 14 and 15

The operation of each of the fuel metering or injector assemblies 48-1, 48-2, 48-3 and 48-4 of FIG. 15 is the same as that described with reference to FIGS. 1 and 2 and the actuation of such injector assemblies is brought about and controlled by the ECU 90 in the same manner as also described with reference to FIGS. 1 and 2.

Figure 13:
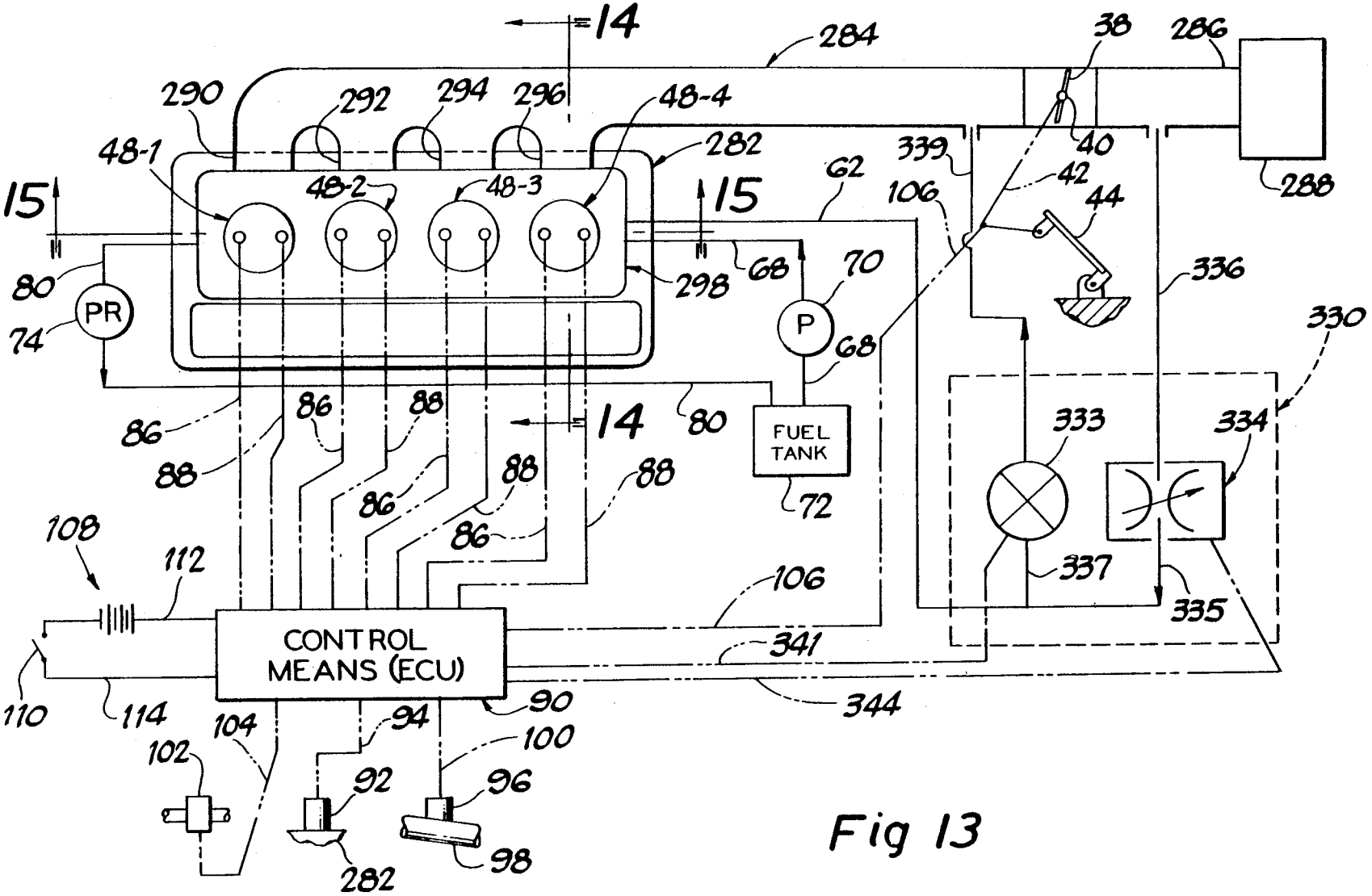
FIG. 13 is a partly diagrammatic and partly schematic view, somewhat similar to FIGS. 12 and 16, of an overall engine assembly and associated controls and accessories, differing from those of FIGS. 12 and 16, employing teachings of the invention.

Further, as each of the injector assemblies of FIGS. 12, 13 and 15 are metering and injecting fuel, the air supplied via conduit means 62, and the conduit means comprised of conduit sections 320, 322, 324 and 326, flows through the nozzles of the respective nozzle means 50-1, 50-2, 50-3 and 50-4 to impinge upon the spray of metered fuel (from the respective injectors 48-1, 48-2, 48-3 and 48-4) in the manner and for the purposes described with reference to FIGS. 2-6.

The embodiment of FIG. 12 is illustrated as employing air flow restriction means 330. Such restriction means 330 is depicted as, in turn, comprising first and second air flow restrictors 332 and 334. Restrictor 332 may be a mechanically adjustable restriction, in parallel with restriction 334, selectively set to provide the desired total air flow through the restriction means 333 as at, for example, normal engine temperature operating conditions. Restrictor 334 is, preferably, an electrically adjustable restriction or orifice which is adjustable as by an electrically driven stepper motor many forms of which are well known in the art. Generally, the effective flow area of restrictor means 334 would increase during conditions of cold engine start-up and drive-away, cold engine idle operation and during conditions of additional applied engine loads as may occur, for example, during curb-idle engine operation and the intermittent interconnection to the engine of vehicular air conditioning compressor means.

The air restriction or controller means 330 has air supply conduit means 336 leading thereto as from an area in said induction passage means 284 downstream of the air cleaner means 288 and upstream of the throttle valve means 38. As should now be apparent, the conduit means 336 could communicate directly with the interior of the air cleaner assembly 288. An outlet conduit portion 338, of air controller means 330, communicates with air supply conduit means 62. The mechanically set or determined air flow orifice means 332 may have its inlet connected to conduit means 336, as by conduit means 340, and its outlet connected to conduit portion or means 338 as by conduit means 342. Further, suitable conductor means 344 serves to operatively interconnect the ECU 90 and the electrical motor means of the electrically adjustable variable orifice means 334 to thereby cause adjustment of variable flow orifice means 334 to satisfy the then engine operating conditions as sensed by the ECU 90.

As illustrated, in the preferred form of the embodiment of FIG. 12, a low leakage throttle body is provided so that all, or substantially all, of the engine curb-idle air flow is provided by and through the air restriction or controller means 330 effectively bypassing the throttle valve means 38. Such a low leakage throttle body increases the effectiveness of this system.

In such an arrangement all of the curb-idle air flows through supply conduit means 62 to and through the air nozzle means 50-1, 50-2, 50-3 and 50-4. Consequently, the flow of air through such air nozzle means 50-1, 50-2, 50-3 and 50-4 will be the result of the then effective flow area of restriction or controller means 330, the effective flow areas of the air nozzles comprising the nozzle means 50-1, 50-2, 50-3 and 50-4 and the pressure differential, as exists from upstream of air controller or restriction means 330 (between air cleaner 288 and the closed throttle 38) to downstream of the respective air nozzles, the latter being the intake- manifold vacuum generated by the engine in its operation. Therefore, the greatest rate of air flow through the nozzle means 50-1, 50-2, 50-3 and 50-4 would occur during curb-idle engine operation as well as possibly during the periods of when, during closed throttle deceleration, the vehicle is driving the engine.

In view of the foregoing, it can be seen that in the embodiment of FIG. 12, the air supplied via nozzle means 50-1, 50-2, 50-3 and 50-4 not only impinges upon the already metered fuel flow but also provides the air flow necessary for curb-idle engine operation. Further, since the rate of air flow through nozzle means 50-1, 50-2, 50-3 and 50-4, in the embodiment of FIG. 12, is dependent upon the magnitude of engine or manifold (as in the area of 304 of FIG. 14) vacuum, there would be generally less impingement of air, upon the metered fuel flow, as the engine load (intake manifold pressure) increases.

It should be understood that the by-pass air assembly 330, which is shown in FIG. 12 as a remote device, could be integrated, as shown in FIG. 12*a*, into a suitable support structure 299, such as the fuel rail 298 or the induction passage means 284, for example. It is apparent that for V-type engines with two or more cylinder banks, there may be a fuel rail/by-pass air assembly structure for each cylinder bank.

In the embodiment of FIG. 13, all elements which are like or similar to those of FIGS. 12, 14 and 15 are identified with like reference numbers. Referring in greater detail to the embodiment of FIG. 13, such differs from the embodiment of FIG. 12 by having the air flow restriction means 330 comprise a further control means 333 which, for example, may be a solenoid operated valve assembly. Such solenoid valve means 333, in turn, is operatively connected to the conduit means 62 and conduit means 335 as by conduit or passage means 337 and, further, connected as by conduit or passage means 339 to the induction passage means 284 as at an area downstream of the throttle valve means 38.

Generally, when the solenoid valve 333 is open, flow upstream of the throttle means 38 is allowed to flow to the downstream side of the throttle means 38 via passage means 336, flow restrictor means 334, conduit 335, conduit 337, valve assembly 333 and conduit 339. Such flow, and the degree thereof, is controlled by the signal transmitted from the ECU 90 via transmission means 344 to flow restrictor means 334 and by a signal transmitted to the valve assembly 333 by the ECU 90 via transmission means 341. During such periods when solenoid valve means 333 is opened, some flow of air occurs through conduit means 62 to the air nozzle means 50-1, 50-2, 50-3 and 50-4.

In the embodiment of FIG. 13, during low temperature cold engine starting, the solenoid valve means 333 would be open thereby providing for the relatively larger air flow needed for this condition. At this time there would also be some relatively small air flow through each of the air nozzle means 50-1, 50-2, 50-3 and 50-4 to thereby assist in fuel preparation; i.e., the enhanced atomization of the metered fuel. Following such a cold start, when the engine 282 attains a preselected engine operating temperature (as sensed by, for example, means 92) considerably less bypass air (bypassing throttle valve means 38) is needed in order to sustain, for example, curb-idle engine operation and therefore, when such preselected engine operating temperature is attained, the solenoid valve means 333 is closed thereby directing all the bypass air (via conduit 336, flow restrictor means 334, conduit 335 and passage 62) to the air nozzle means 50-1, 50-2, 50-3 and 50-4. By so doing the flow restriction means 330 and, in particular, flow restrictor means 334, through the signals applied thereto via transmission means 344 from ECU 90, becomes effective for controlling idle engine speed once the preselected engine operating temperature is attained. Further, the same elements along with the opened solenoid valve 333 would also be effective for controlling idle engine speed at engine temperatures less than said preselected engine operating temperature.

Figure 16:
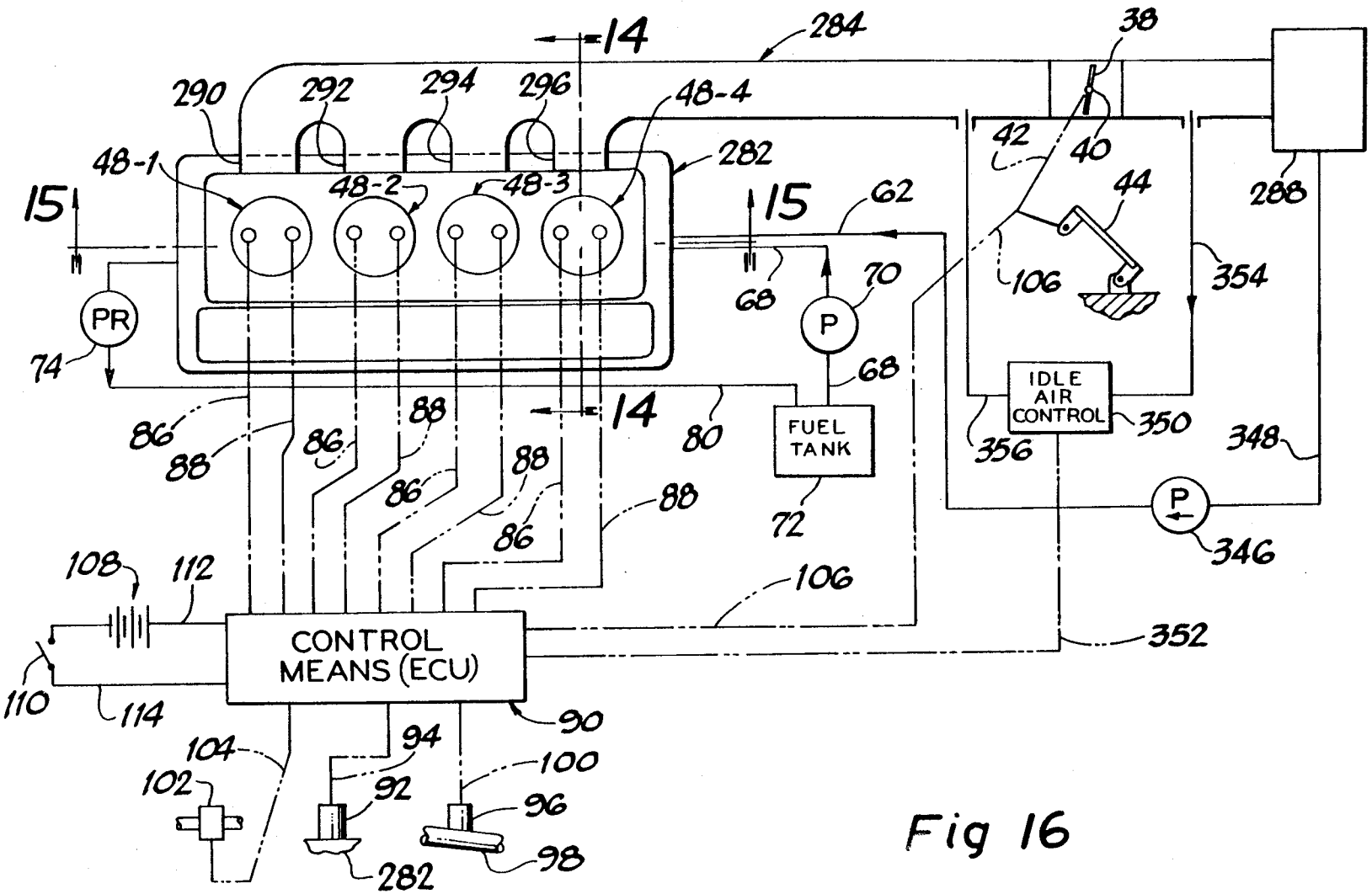
FIG. 16 is a partly diagrammatic and partly schematic view, somewhat similar to FIG. 12, of an overall engine assembly and associated controls and accessories, differing from those of FIG. 12, employing teachings of the invention.

Operation of the Apparatus of FIGS. 14, 15 and 16

In FIG. 16, elements and/or details which are like or similar to any of the preceding Figures are identified with like reference numbers. An inspection of the embodiments of FIGS. 12 and 16 will show that the two are the same except for the manner in which air is provided for the air nozzle means 50-1, 50-2, 50-3 and 50-4.

With the exceptions hereinafter described in detail, the operation of the embodiment of FIG. 16, which would comprise the typically depicted structures of FIGS. 14 and 15, is the same as the operation of the embodiment of FIG. 12, which would also comprise the typically depicted structures of FIGS. 14 and 15, as hereinbefore described.

Referring in greater detail to FIG. 16, the embodiment therein is shown as being provided with air pump means 346 having its inlet connected as via conduit means 348 to a source of air as, for example, the interior of the associated air cleaner assembly 288. The outlet of air pump means 346 communicates with air supply conduit means 62.

Air pump means 346 may be either electrically as by associated electrical motor means or mechanically driven as by operative connection to the engine 282.

In the event that the air pump means 346 were to be electrically driven, the speed thereof could, if desired, be substantially constant with the output thereof being sufficient to provide for the degree of metered fuel atomization desired (by the air flow through the air nozzle means 50-1, 50-2, 50-3 and 50-4) during all engine loads.

In the event that the air pump means 346 were to be mechanically driven by the engine 282, the speed of the air pump means and its output would increase with an increase in engine speed. The output, however, could be regulated (as to, for example, a maximum magnitude) by any suitable regulating means many of which are well known in the art.

The embodiment of FIG. 16 also contemplates the possibility of providing engine idle air controller means 350 as, especially in recent years, has often been employed to by-pass the throttle valve means 38. The air controller means 350 may be comprised of variable orifice means controlled by electrically operated stepper motor means, operationally electrically coupled as via conductor means 352 to ECU 90, and inlet conduit means 354, communicating as with the induction passage means 284 upstream of throttle valve means 38, and outlet conduit means 356 communicating as with the induction passage means 284 downstream of throttle valve means 38.

In view of the foregoing it should be apparent that the source or air supply means 60 of FIG. 1 could be the air source or air supply means as disclosed and described with reference to FIGS. 12 and 16 and that the calibrated passage means 64 could comprise the functionally equivalent means of FIGS. 12 and 16 as, for example, controller means 330.

The respective air nozzles, in any of the embodiments disclosed could be any of the configurations of FIGS. 9, 10 and 11, as well as other configurations, and such may be positioned in any selected relative position as described, for example, with reference to FIGS. 2, 3, 4, 5, 6, 7 and 8.

Further, it should be made clear that the practice of the invention is not limited to the use of the specific form or type of metering or injector means 48 disclosed.

Although only the presently known preferred embodiments of the invention have been disclosed and described, it is apparent that other embodiments and modifications of the invention are possible within the scope of the appended claims.

What is claimed is:

1. Apparatus for supplying rates of metered fuel flow to an associated engine having induction passage means, comprising fuel injector means for injecting rates of metered fuel flow into said induction passage means, air nozzle means, said air nozzle means being effective to direct a stream of air to impinge upon said metered fuel flow as has been injected by said fuel injector means to thereby atomize said metered fuel flow, wherein said air and said atomized metered fuel flow both flow to said engine, and air-flow supply means communicating with said air nozzle means, wherein said air-flow supply means comprises variable orifice means responsive to indica of engine operation for regulating the mass rate of flow of air to said air nozzle means, wherein said air-flow supply means comprises second orifice means of selected effective flow area, and wherein said variable orifice means and said second orifice means are arranged in parallel flow relationship with each other.

2. A fuel supply system for supplying metered fuel to a combustion engine having at least first and second combustion chambers, comprising induction passage means, throttle valve means for variably controlling the rate of flow of air through said induction passage means, wherein said induction passage means comprises at least first and second induction branches downstream of said throttle valve means, wherein said first and second induction branches respectively communicate with said first and second combustion chambers, first and second fuel injectors respectively communicating with said first and second induction branches, said first fuel injector being effective for injecting metered rates of fuel flow into said first induction branch and said second fuel injector being effective for injecting metered rates of fuel flow into said second induction branch, fuel supply conduit means, said fuel supply conduit means communicating with a source of fuel and said first and second fuel injectors, fuel pressure regulating means communicating with said fuel supply conduit means for regulating the pressure of said fuel supplied to said first and second fuel injectors, first and second air nozzle means, said first air nozzle means comprising a first plurality of air nozzles for directing a first plurality of streams of air to impinge upon said metered fuel flow as has been injected by said first fuel injector into said first induction branch to thereby atomize said metered fuel flow in said first induction branch, said second air nozzle means comprising a second plurality of air nozzles for directing a second plurality of streams of air to impinge upon said metered fuel flow as has been injected by said second fuel injector into said second induction branch to thereby atomize said metered fuel flow in said second induction branch, air conduit means communicating with a source of air and said first and second pluralities of air nozzles, and further comprising air flow restriction means communicating with said source of air and said air conduit means, wherein said air flow restriction means comprises a first flow restrictor of fixed flow area and a second flow restrictor of variable flow area, and wherein the flow of air through both said first and second flow restrictors is directed to said air conduit means.

3. Apparatus according to claim 1 and further comprising means for supplying said air at super atmospheric pressure, throttle valve means for variably controlling the rate of flow of air through said induction passage means, wherein said metered fuel flow is injected into said induction passage means in an area upstream of said throttle valve means, and wherein said stream of air impinges upon said metered fuel flow in an area upstream of said throttle valve means.

4. A fuel supply system for supplying metered fuel to a combustion engine having at least first and second combustion chambers, comprising induction passage means, throttle valve means for variably controlling the rate of flow of air through said induction passage means, wherein said induction passage means comprises at least first and second induction branches downstream of said throttle valve means, wherein said first and second induction branches respectively communicate with said first and second combustion chambers, first and second fuel injectors respectively communicating with said first and second induction branches, said first fuel injector being effective for injecting metered rates of fuel flow into said first induction branch and said second fuel injector being effective for injecting metered rates of fuel flow into said second induction branch, fuel supply conduit means, said fuel supply conduit means communicating with a source of fuel and said first and second fuel injectors, fuel pressure regulating means communicating with said fuel supply conduit means for regulating the pressure of said fuel supplied to said first and second fuel injectors, first and second air nozzle means, said first air nozzle means comprising a first plurality of air nozzles for directing a first plurality of streams of air to impinge upon said metered fuel flow as has been injected by said first fuel injector into said first induction branch to thereby atomize said metered fuel flow in said first induction branch, said second air nozzle means comprising a second plurality of air nozzles for directing a second plurality of streams of air to impinge upon said metered fuel flow as has been injected by said second fuel injector into said second induction branch to thereby atomize said metered fuel flow in said second induction branch, air conduit means communicating with a source of air and said first and second pluralities of air nozzles, wherein said air conduit means and said first and second pluralities of air nozzles are continuously open to air flow therethrough during operation of said engine, and further comprising air flow restriction means communicating between said source of air and said air conduit means, wherein said air flow restriction means comprises a first flow restrictor of variable flow area and a second valving assembly, wherein said second valving assembly is openable and closeable in response to indicia of engine operation, wherein the flow area of said first flow restrictor is determined in response to indicia of engine operation, wherein when the temperature said second valving assembly is moved in the opening direction as to divert a portion of the air flow intended for said air conduit means, and wherein said diverted portion of air flow is discharged into said induction passage means downstream of said throttle valve means and upstream of where said streams of air impinge upon said injected metered fuel flow.

5. Apparatus for supplying rates of metered fuel flow to an associated engine having induction passage means, comprising fuel injector means for injecting rates of metered fuel flow into said induction passage means, and air nozzle means, said air nozzle means being effective to direct a stream of air to impinge upon said metered fuel flow as has been injected by said fuel injector means to thereby atomize said metered fuel flow, wherein said air and said atomized metered fuel flow both flow to said engine, and wherein said stream of air impinging upon said metered fuel flow is of a mass rate of flow sufficient to provide the required air flow to said engine to sustain idle engine operation at any temperature.

6. Apparatus for supplying rates of metered fuel flow to an associated engine having induction passage means, comprising fuel injector means for injecting rates of metered fuel flow into said induction passage means, and air nozzle means, said air nozzle means being effective to direct a stream of air to impinge upon said metered fuel flow as has been injected by said fuel injector means to thereby atomize said metered fuel flow, wherein said air and said atomized metered fuel flow both flow to said engine, and wherein said stream of air impinging upon said metered fuel flow is of a mass rate of flow sufficient to provide the required air flow to said engine to sustain any desired idle engine speed at any engine temperature.

7. In an internal combustion engine having an induction passage controlled by a throttle valve characterized by low air leakage at closed throttle idle position, and fuel injection means for injecting a predetermined quantity of fuel, said engine requiring a predetermined quantity of combustion air to maintain a predetermined engine idle speed at any engine operating parameter, means including a variably controlled orifice means continuously open during engine operation for bypassing such predetermined quantity of combustion air around said closed low leakage throttle valve, said bypass means including means for strategically routing said predetermined quantity of at least some portion of said bypassed idle air so that it impinges said injected fuel as it exits said fuel injection means, whereby the kinetic energy of said bypassed air is not wasted but used to further atomize said injected fuel, thereby improving fuel preparation for combustion and resulting in better idle quality, increased fuel economy and/or harmful exhaust emissions.

8. The invention recited in claim 7, wherein said variably controlled orifice means includes stepper motor control means.

9. The invention recited in claim 7, wherein said fuel injection means includes a fuel rail assembly and wherein said variably controlled orifice means comprises a part of said fuel rail assembly.

10. Apparatus for supplying rates of metered fuel flow to an associated engine having induction passage means, comprising a fuel injector for injecting rates of metered fuel flow into said induction passage means for the operation of said engine, and a plurality of air nozzles, each of said plurality of air nozzles being effective during operation of said engine to continuously direct respective streams of air to an area generally downstream of said fuel injector as to impinge upon said metered fuel flow as has been injected by said fuel injector to thereby atomize said metered fuel flow, wherein said air and said atomized fuel flow both flow to said engine, and wherein at least certain of said plurality of air nozzles is positioned as to cause the stream of air flowing therefrom to impinge upon said metered fuel flow in a manner whereby the axis of flow of said stream of air does intersect with the axis of flow of said metered fuel flow.

11. Apparatus according to claim 1 wherein said second orifice means is initially manually selectively adjustable to said selected effective flow area.

12. Apparatus for supplying rates of metered fuel flow to an associated engine having induction passage means, comprising a fuel injector for injecting rates of metered fuel flow into said induction passage means for the operation of said engine, and a plurality of air nozzles, each of said plurality of air nozzles being effective during operation of said engine to continuously direct respective streams of air to an area generally downstream of said fuel injector as to impinge upon said metered fuel flow as has been injected by said fuel injector to thereby atomize said metered fuel flow, wherein said air and said atomized fuel flow both flow to said engine, and wherein the rate of flow of said air through said plurality of air nozzles is sufficient to sustain idle operation of said engine.

* * * * *